US006697599B2

(12) United States Patent
Scherdel

(10) Patent No.: US 6,697,599 B2
(45) Date of Patent: Feb. 24, 2004

(54) DEVICE FOR REMOVING A COATING ADHERING TO AN INTERMEDIATE CARRIER IN AN ELECTROPHOTOGRAPHIC PRINTER OR COPIER DEVICE

(75) Inventor: Stefan Scherdel, Markt Schwaben (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 10/152,130

(22) Filed: May 21, 2002

(65) Prior Publication Data

US 2002/0181982 A1 Dec. 5, 2002

(30) Foreign Application Priority Data

May 23, 2001 (DE) ..... 101 25 326

(51) Int. Cl.[7] ..... G03G 21/00
(52) U.S. Cl. ..... 399/350; 15/256.51; 399/349
(58) Field of Search ..... 399/350, 349, 399/347, 99; 15/1.51, 256.5, 256.51; 430/125

(56) References Cited

U.S. PATENT DOCUMENTS

| | | | | | |
|---|---|---|---|---|---|
| 3,848,992 | A | * | 11/1974 | Smith | 399/350 |
| 4,048,919 | A | * | 9/1977 | Woods | 15/256.51 X |
| 4,491,161 | A | * | 1/1985 | Tamura et al. | 141/364 |
| 5,349,428 | A | * | 9/1994 | Derrick | 399/350 X |
| 5,500,724 | A | * | 3/1996 | Campbell et al. | 399/350 X |
| 5,766,753 | A | * | 6/1998 | Murata et al. | 428/323 |
| 5,832,355 | A | | 11/1998 | Köfferlein | 399/349 |
| 5,991,568 | A | * | 11/1999 | Ziegelmuller et al. | 399/349 X |
| 6,021,304 | A | * | 2/2000 | Sbert et al. | 399/349 |
| 6,072,977 | A | | 6/2000 | Murakami | 399/313 |
| 6,463,253 | B2 | * | 10/2002 | Sato | 399/350 |

FOREIGN PATENT DOCUMENTS

| | | | |
|---|---|---|---|
| DE | 21 11 509 | | 8/1977 |
| DE | 197 49 386 | | 2/2000 |
| EP | 0 411 579 | | 2/1991 |
| EP | 0 535 875 | | 4/1993 |
| JP | 59-218477 | * | 12/1984 |
| JP | 01-169477 | * | 7/1989 |
| JP | 03-067292 | * | 3/1991 |
| JP | 03-170989 | * | 7/1991 |

* cited by examiner

*Primary Examiner*—Sophia S. Chen
(74) *Attorney, Agent, or Firm*—Schiff Hardin & Waite

(57) ABSTRACT

In order to strip a film-like coating having toner residues, abrasion and paper dust from an intermediate carrier (for example, a photoconductor), a cleaning unit is provided that is planarly executed and bent such that first and second surfaces and a rounded-off bending region arise. The cleaning unit has its first surface arranged parallel to the intermediate carrier such that the coating runs through under the bending region and then between the first surface and the intermediate carrier, so that the toner contained in the coating loosens the coating from the intermediate carrier.

21 Claims, 1 Drawing Sheet

DEVICE FOR REMOVING A COATING ADHERING TO AN INTERMEDIATE CARRIER IN AN ELECTROPHOTOGRAPHIC PRINTER OR COPIER DEVICE

BACKGROUND OF THE INVENTION

An electrophotographic printer or copier devices are known, for example, from U.S. Pat. No. 6,072,977 or DE 197 49 386 C2, incorporated herein. They comprise a photoconductor drum or a photoconductive band as an intermediate carrier on which an image of the image to be printed on a recording medium, for example a paper web, is generated by charge transfer using a character generator. Subsequently, the intermediate carrier is conducted past a toner station with which the charge image on the intermediate carrier is inked with toner. The toner image is transferred from the intermediate carrier onto the recording medium in a transfer printing station and is fixed thereon in a fixing station. The printing or copying event for an image has thus been ended. The intermediate carrier is discharged and is then available for a new printing or copying event.

In electrophotographic printers or copiers, a coating comprising deposits, for example of toner, paper dust and abrasion, forms on the photoconductive intermediate carrier given longer operation, or forms on some other intermediate carrier that, for example, transfers the print image from the photoconductive intermediate carrier onto the recording medium. This coating is usually formed as a film. It must be removed since it deteriorates the printing quality Up to now, the film was removed with cleaning brushes or with a stripper, referred to as blades. An example of these cleaning methods derives from U.S. Pat. No. 5,832,355, incorporated herein.

Given cleaning brushes, a very hard cleaning brush is required in order to remove the film. As a result thereof, the photoconductor can be scratched, for example given organic photoconductive intermediate carriers on a plastic substrate.

Given a blade, the blade edge was hitherto utilized for the cleaning. When the edge has become worn, the cleaning effect deteriorates and the blade must be replaced. The cleaning effect is good for loose toner; a film-like coat, in contrast, is difficult to remove.

A problem underlying the invention is comprised in specifying a device with which the film-like coating of deposits can be reliably and gently removed from the intermediate carrier.

SUMMARY OF THE INVENTION

According to the present invention, for removal of a coating of deposits adhering to a surface of an intermediate carrier in an electrophotographic printer or copier device, a planarly designed cleaning unit of elastic material is provided that is bent over such that first and second surfaces in a rounded-off bending region are provided. The cleaning unit is arranged relative to the intermediate carrier such that the first surface lies flush in parallel on the intermediate carrier; the bending region points in a direction of the coating to be removed; and the first surface lies against the intermediate carrier such that the coating with toner contained therein is conveyed through between the intermediate carrier and the first surface.

DESCRIPTION OF THE PREFERRED EMBODIMENTS

Figure 1:
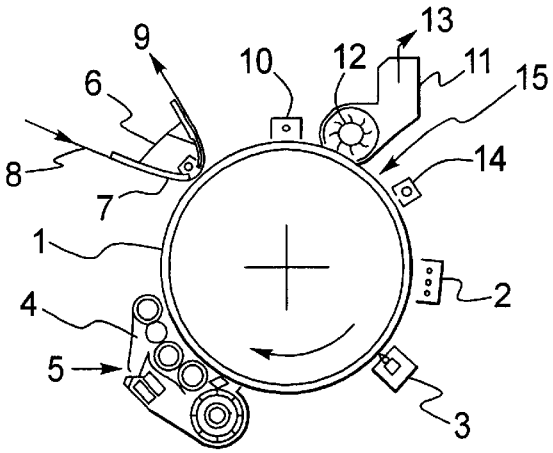
FIG. 1 is a schematic structure of an electrographic printer or copier device.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

A planar cleaning unit, namely a drawn blade (therefore also called blade below) is utilized in the device. In contrast to the standard employments, however, it is not the blade edge but the surface that is employed for the cleaning. For that purpose, the blade is implemented broad and soft so that the blade comes to lie parallel to the surface of the intermediate carrier to be cleaned.

The effective mechanism of the cleaning given this device is thus different than given the conventional cleaning device (U.S. Pat. No. 5,832,355). Whereas the coating, for example the toner, was previously pushed in front of the blade by the blade edge and thereby lifted off from the intermediate carrier, a small part of the toner contained in the deposits is conveyed past between the blade and the intermediate carrier in the present device. The toner rolls between the blade and the intermediate carrier and collects deposits located on the intermediate carrier.

A large crumb comprising of deposits thus remains behind the blade, this, for example, being capable of being removed or extracted in a known way by a following cleaning device.

The silica (silicon oxide particles) in the toner also results in the surface of the intermediate carrier being polished. As a result thereof, further contaminants are eroded and scratches are also smoothed.

The following advantages thus derive:

Deposits that are on the surface of the intermediate carrier as a film can be cleaned off.

The sharpness of the blade edge plays no part in the cleaning effect of the blade since the cleaning effect is achieved by the blade surface. As a result thereof, the blade is inexpensive to manufacture.

The blade has a longer service life than a blade in a traditional arrangement.

Small scratches in the surface of the intermediate carrier to be cleaned can be polished out. The toner (or, respectively, the silica in the toner) serves as polishing agent.

It is important that no toner residues agglomerate to the blade, so the toner would otherwise be smeared on the intermediate carrier, as a result whereof pronounced deposits and scratches could arise. This can be achieved by means of a suitable selection of the blade material. A blade material having a hardness <60 Shore A is preferably selected.

It is expedient when the second surface of the blade is held in a mount.

In order to set the pressing power of the blade against the intermediate carrier, it is advantageous when a spring sheet lies against the inside of the blade, this pressing the blade against the intermediate carrier.

Since the coating is loosened by the blade, a cleaning device, for example a brush device, can be additionally provided, this completely removing the loosened coating. When this additional cleaning device is arranged in front of the blade, this also has the advantage that is reduces the amount of residual toner on the intermediate carrier that is conveyed under the blade.

Advantageously, the blade is manufactured of a soft material, for example of a plastic having a hardness <60 Shore A. Plastics that meet this demand made of the blade are, for example, silicone, PUR, EPDM, SBR, NBR.

It is advantageous when the thickness of the blade amounts to approximately 1 mm and the thickness of the spring sheet is approximately 0.08 mm.

FIG. 1 shows a schematic arrangement of the components in an electrophotographic printer or copier device. An intermediate carrier 1—a photoconductor drum in FIG. 1 but also a photoconductor band—moves past the components with a constant velocity. First, the intermediate carrier 1 is charged by a charging corotron 2. The image to be printed is generated on the intermediate carrier as a charge image with sharply focused light using a character generator 3. Subsequently, the charge image is inked with toner 5 in a developer station 4. The toner image is finally transferred onto a recording medium 8, for example paper, in a transfer station 6, for example with the assistance of a transfer printing corotron 7, and is then fixed in a fixing station 9 (not shown). Subsequently, the intermediate carrier 1 is electrostatically neutralized with a corotron 10. The residual toner that still adheres to the intermediate carrier 1 is removed for a new image cycle by means of a cleaning device 11, for example a cleaning brush 12 and extraction unit 13. Finally, the intermediate carrier 1 is exposed by a discharge lamp 14 for improving its long-term behavior. The intermediate carrier 1 is now ready for a new printing cycle.

Figure 2:
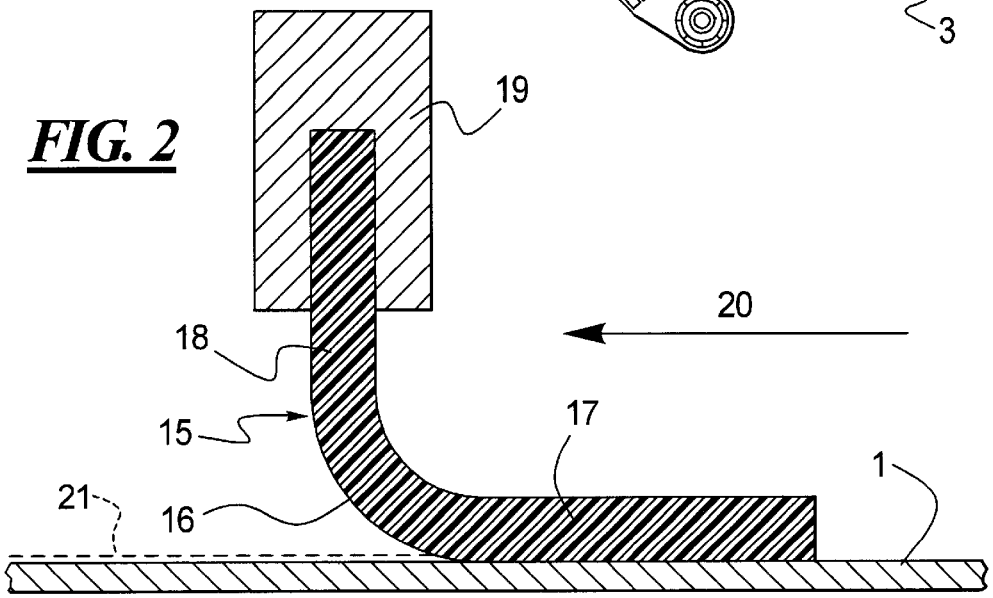
FIG. 2 is a first embodiment of the device.
Figure 3:
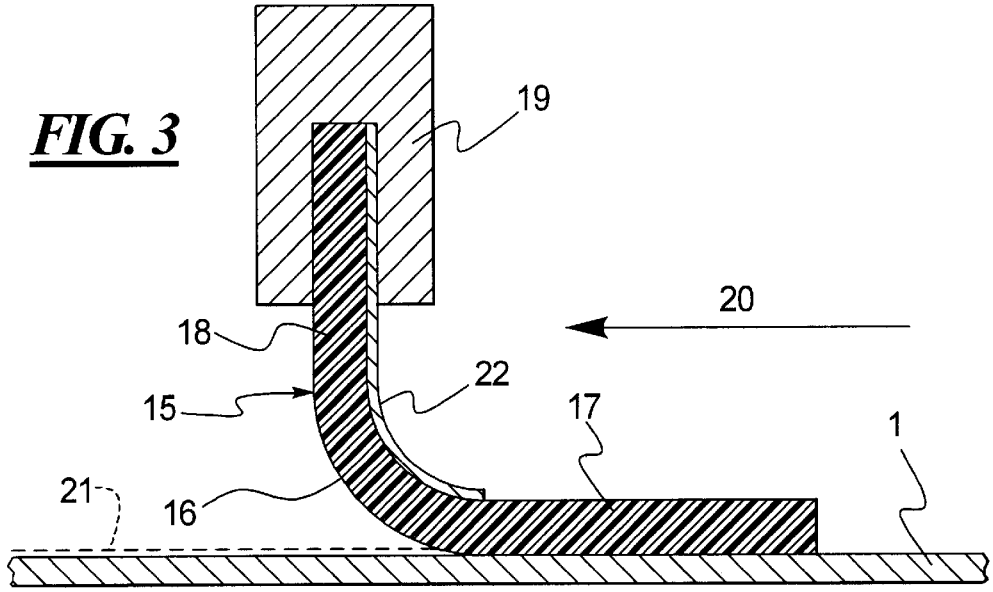
FIG. 3 is a second embodiment of the device.

During operation, a film-like coating 21 of deposits comprised, for example, of residual toner, abrasion and paper dust forms on the intermediate carrier 1. This coating 21 cannot be optimally removed by the cleaning device 11. In order to strip this coating without damaging the intermediate carrier 1, a cleaning unit 15 according to FIGS. 2 and 3 is provided, this being planarly formed and curved such that a rounded-off bending region 16 and first and second surfaces 17, 18 arise. This cleaning unit is also called a blade below.

The blade 15 is comprised, for example, of a soft plastic, for example silicone, EPDM (ethylene propylene terpolymer), SBR (styrol butadiene), NBR (acryl nitrile butadiene), PUR (polyurethane) or many other soft plastic materials, and has a thickness of approximately 1 mm. The first surface 17 of the blade lies flush and parallel on the intermediate carrier 1, whereas the second surface 18 can be clamped in a mount 19. The blade 15 is thereby arranged relative to the intermediate carrier (a band in FIG. 2 or 3) such that the rounded-off bending region 16 lies opposite the moving direction of the intermediate carrier 1. As a result thereof, the coating 21 of deposits strikes the bending region 16 and is conveyed through between the first surface 17 and the intermediate carrier 1. The toner contained in the coating, as set forth above, strips the film-like coating from the intermediate carrier 1.

With a cleaning device to be provided in addition to the cleaning unit 15 and that can be realized as a brush cleaning device 11 in conformity with FIG. 1, the loosened coating 21 can then be removed from the intermediate carrier 1 in a simple way. When the cleaning device is arranged in front of the blade 15, this can be used for reducing the residual toner on the intermediate carrier 1 such that too much toner, which could otherwise impede the friction action of the blade, is not conveyed through under the blade.

The position of the cleaning unit 15 relative to the other components in the printer or copier device is indicated by an arrow 15 in FIG. 1.

In the exemplary embodiment according to FIG. 3, the thin blade 15 is assisted by a spring sheet 22 (approximately 0.08 mm thick). The pressing power can be set by the spring sheet 22

The relative moving direction between intermediate carrier 1 and cleaning unit 15 also derives from FIGS. 2 and 3; this is shown with the arrow 20.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

I claim as my invention:

1. A device for removal of a coating of deposits adhering to a surface of an intermediate carrier in an electrophotographic printer or copier device, comprising:

a planarly designed cleaning unit of elastic material that is bent over such that first and second surfaces and a rounded-off bending region are provided; and the cleaning unit being arranged relative to the intermediate carrier such that the first surface lies flush and parallel on the intermediate carrier, the bending region points in a direction of the coating to be removed, and the first surface lies against the intermediate carrier such that the coating with toner contained therein is conveyed through between the intermediate carrier and the first surface.

2. The device according to claim 1 wherein the second surface is seated in a mount.

3. The device according to claim 1 wherein a spring sheet with which a pressing power of the cleaning unit is set lies against an inside surface of the cleaning unit.

4. The device according to claim 3 wherein the spring sheet comprises a thickness of approximately 0.08 mm.

5. The device according to claim 1 wherein a material of the cleaning unit comprises a hardness <60 Shore A.

6. The device according to claim 1 wherein the cleaning unit comprises plastic.

7. The device according to claim 6 wherein the plastic comprises EPDM ethylene propylene terpolymer.

8. The device according to claim 6 wherein the plastic comprises polyurethane.

9. The device according to claim 6 wherein the plastic comprises SBR-styrol butadiene.

10. The device according to claim 6 wherein the plastic comprises NBR-acryl nitrile butadiene.

11. The device according to claim 6 wherein the plastic comprises silicone.

12. The device according to claim 1 wherein the cleaning unit comprises a thickness of approximately 1 mm.

13. The device according to claim 1 wherein the cleaning unit comprises a blade.

14. A device for removal of a coating of deposits adhering to a surface of an intermediate carrier in a printer or copier device, comprising:

a cleaning unit of elastic material that is bent over such that first and second surfaces and a rounded-off bending region between the first and second surfaces are provided; and the cleaning unit being arranged relative to the intermediate carrier such that the first surface lies flush and parallel on the intermediate carrier;

the bending region points in a direction of the coating to be removed;

the first surface lying against the intermediate carrier such that the coating with toner contained therein is conveyed through between the intermediate carrier and the first surface; and the second surface being connected to a mount.

15. The device according to claim 14 wherein a further cleaning unit is provided wherein the further cleaning unit loosens the coating from the intermediate carrier and said cleaning unit removes the loosened coating from the intermediate carrier.

16. The device according to claim 15 wherein the further cleaning unit is positioned upstream from and adjacent the cleaning unit.

17. The device according to claim 16 wherein the further cleaning unit comprises a wire brush.

18. A method for removing a coating of deposits adhering to an intermediate carrier in an electrophotographic printer or copier device, comprising the steps of:

providing a planarly designed, curved cleaning unit with a first surface lying parallel on the intermediate carrier such that a bending region faces toward the coating on the intermediate carrier;

moving the intermediate carrier relative to the cleaning unit such that the coating on the intermediate carrier runs through under the bending region and under the first surface; and with toner contained in the coating loosening the coating with the cleaning unit from the intermediate carrier such that it can be removed from the intermediate carrier.

19. A method for removing a coating of deposits adhering to an intermediate carrier in an electrophotographic printer or copier device, comprising the steps of:

providing a planarly designed, curved cleaning unit with a first lateral surface lying parallel on the intermediate carrier such that a bending region faces toward the coating on the intermediate carrier;

moving the intermediate carrier relative to the cleaning unit such that the coating on the intermediate carrier first runs through under the bending region and then under the first lateral surface; toner contained in the coating loosening the coating from the intermediate carrier such that it can be removed from the intermediate carrier: and removing the loosened coating with the cleaning unit.

20. A system for removal of a coating of deposits adhering to a surface of an intermediate carrier in a printer or copier device, comprising:

a cleaning unit of elastic material that is bent over to form a rounded-off bending region followed by a flat surface;

the cleaning unit being arranged relative to the intermediate carrier such that said flat surface lies flush against and parallel to said surface of the intermediate carrier, and the bending region points in a direction of the coating to be removed, the flat surface lying against the intermediate carrier such that the coating is conveyed through between the intermediate carrier and the flat surface and removed; and a further cleaning unit upstream of said cleaning unit, said further cleaning unit loosening the coating from the intermediate carrier prior to said cleaning unit removing the loosened coating from the intermediate carrier.

21. A method for removing a coating of deposits adhering to a surface of an intermediate carrier in an electrographic printer or copier device, comprising the steps of:

providing a cleaning unit with a flat surface lying substantially parallel to and on the intermediate carrier surface and having a bending region facing toward the coating on the intermediate carrier;

providing a further cleaning unit upstream of said cleaning unit; and moving the intermediate carrier relative to the cleaning unit and said further cleaning unit such that the coating on the intermediate carrier is first loosened by the further cleaning unit and then said loosened coating first runs under said bending region and then under said flat surface, toner contained in the coating loosening the coating from the intermediate carrier surface such that the coating can be removed from the intermediate carrier by the cleaning unit.

* * * * *